US008757793B2

(12) United States Patent
Yamamoto

(10) Patent No.: US 8,757,793 B2
(45) Date of Patent: Jun. 24, 2014

(54) LIQUID EJECTION DEVICE

(71) Applicant: Seiko Epson Corporation, Tokyo (JP)

(72) Inventor: Takao Yamamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/771,652

(22) Filed: Feb. 20, 2013

(65) Prior Publication Data

US 2013/0229474 A1 Sep. 5, 2013

(30) Foreign Application Priority Data

Mar. 2, 2012 (JP) ..... 2012-046265

(51) Int. Cl.
*B41J 2/01* (2006.01)

(52) U.S. Cl.
USPC ..... 347/104; 347/101; 347/16

(58) Field of Classification Search
USPC ..... 347/104, 101, 16
See application file for complete search history.

(56) References Cited

U.S. PATENT DOCUMENTS

| | | | | |
|---|---|---|---|---|
| 6,270,215 | B1 | 8/2001 | Miyasaka et al. | |
| 6,367,999 | B1 | 4/2002 | Juan et al. | |
| 6,927,841 | B2 | 8/2005 | Hinojosa et al. | |
| 7,144,106 | B2 | 12/2006 | Ishii et al. | |
| 7,322,690 | B2 | 1/2008 | Ishii et al. | |
| 7,887,179 | B2 | 2/2011 | Toyoshima | |
| 8,287,119 | B2 * | 10/2012 | Yamaguchi et al. | 347/104 |
| 2011/0074872 | A1 | 3/2011 | Ozaki et al. | |
| 2011/0221843 | A1 * | 9/2011 | Ozaki | 347/104 |
| 2013/0208065 | A1 * | 8/2013 | Yamamoto et al. | 347/104 |

FOREIGN PATENT DOCUMENTS

| | | | |
|---|---|---|---|
| JP | 06-015902 | A | 1/1994 |
| JP | 08-156351 | A | 6/1996 |
| JP | 11-208045 | A | 8/1999 |
| JP | 2000-135828 | A | 5/2000 |
| JP | 2001-347691 | A | 12/2001 |
| JP | 2001-347710 | A | 12/2001 |
| JP | 2002-120420 | A | 4/2002 |
| JP | 2003-118180 | A | 4/2003 |
| JP | 2003-118181 | A | 4/2003 |
| JP | 2003-118182 | A | 4/2003 |
| JP | 2003-246524 | A | 9/2003 |
| JP | 2005-219434 | A | 8/2005 |
| JP | 2006-181939 | A | 7/2006 |
| JP | 2006-192836 | A | 7/2006 |
| JP | 2006-231612 | A | 9/2006 |
| JP | 2007-098936 | A | 4/2007 |
| JP | 2007-152737 | A | 6/2007 |

(Continued)

*Primary Examiner* — Henok Legesse
(74) *Attorney, Agent, or Firm* — Global IP Counselors, LLP

(57) ABSTRACT

A medium support unit of a liquid ejection device has a negative pressure chamber and a medium support surface so that an ejection medium is supported on the medium support surface by suction, and includes a plurality of first recesses and at least one second recess. The first recesses are in communication with a negative pressure generating unit, and aligned along a width direction. The second recess is disposed at a position corresponding to an end part in the width direction of the ejection medium, and arranged to accept liquid ejected from a liquid ejection head. The second recess is in communication with an adjacent one of the first recesses at a position inward of the end part of the ejection medium. The first recesses are respectively in communication with the negative pressure generating unit via the negative pressure chamber partitioned into a plurality of units in the width direction.

6 Claims, 9 Drawing Sheets

(56) References Cited

FOREIGN PATENT DOCUMENTS

| | | | |
|---|---|---|---|
| JP | 2007-260913 | A | 10/2007 |
| JP | 2007-331255 | A | 12/2007 |
| JP | 2009-067015 | A | 4/2009 |
| JP | 2009-119778 | A | 6/2009 |
| JP | 2010-000694 | A | 1/2010 |
| JP | 2010-137399 | A | 6/2010 |
| JP | 2010-269456 | A | 12/2010 |
| JP | 2010-269609 | A | 12/2010 |
| JP | 2011-046110 | A | 3/2011 |
| JP | 2011-088424 | A | 5/2011 |
| JP | 2011-189538 | A | 9/2011 |

* cited by examiner

LIQUID EJECTION DEVICE

CROSS-REFERENCE TO RELATED APPLICATIONS

This application claims priority to Japanese Patent Application No. 2012-046265 filed on Mar. 2, 2012. The entire disclosure of Japanese Patent Application No. 2012-046265 is hereby incorporated herein by reference.

BACKGROUND

1. Technical Field

The present invention relates to a liquid ejection device for ejecting a liquid on an ejection medium that is supported by suction on a medium support unit.

2. Related Art

From the past, inkjet printers (hereafter referred to simply as "printers") have been put to practical use as liquid ejection devices for ejecting ink as a liquid from a liquid ejection head onto paper as one type of ejection medium that is transported while being supported on a medium support unit, and forming an image containing text or graphics. With this type of printer, on a medium support surface that the medium support unit has, a plurality of indented recesses are arranged in the direction orthogonal to the transport direction of the paper so as to be separated from the paper supported on the medium support surface, and the paper is suctioned to the medium support surface by suction of the paper at the recesses using negative pressure given to these recesses.

With this kind of printer, there are cases when so-called "borderless printing" is performed, by which ink is ejected from the liquid ejection head onto the entire surface of the paper to form an image. With a printer that performs this kind of "borderless printing," the ink ejected from the liquid ejection head is also ejected outside the paper to the recesses at which the paper side edge part (end part) is positioned. Then, for the medium support unit for which the recesses on which ink is ejected in this way are provided on the medium support surface, for example in Japanese Laid-Open Patent Application Publication No. 2010-137399, proposed is a constitution by which the interior of the medium support unit is separated into at least one negative pressure chamber further to the inside of the paper width direction than the recess (borderless port) in which the ink is ejected. With this arrangement, the negative pressure chamber is divided into a negative pressure chamber that gives negative pressure to the recess at which the end part of the paper is positioned to recover ink that went past the end part of the paper during borderless printing or ink mist that floats in conjunction with the ejecting of ink, and a negative pressure chamber that gives negative pressure to the recesses by which the paper is suctioned on the medium support surface further to the inside in the width direction than the end part of the paper. By doing this, disturbance of the air flow inside the negative pressure chamber that gives negative pressure to the recesses that are suctioning the paper is suppressed, and floating of the paper is inhibited by maintaining a designated negative pressure given to the recess that is suctioning the paper.

SUMMARY

However, with the constitution of the medium support unit disclosed in the above mentioned publication, there is communication with negative pressure chambers for which the recess that suctions the end part of the paper in the width direction of the paper and the recess that suctions further to the inside than the paper end part are different, so it is difficult to match the negative pressure given to the recess that suctions the end part of the paper and the negative pressure given to the recess that suctions further to the inside than the paper end part. As a result, by the fact that the suction force of the second recess and the suction force of the first recess that suctions the paper are different, for example, it is easy to have a state occur for which the suction force that suctions the paper end part is strong, and the suction force that suctions further to the inside than the paper end part is weak, or conversely, a state for which the suction force that suctions the paper end part is weak, and the suction force that suctions further to the inside than the paper end part is strong. Therefore, since it is not possible to suction with stability evenly up to the paper edge part in the paper width direction, there is the risk that it will not be possible to suction the paper to the medium support surface stably.

The present invention was created considering the circumstances noted above, and an object is to provide a liquid ejection device that is able to stably support an ejection medium on a medium support surface using suction for a medium support unit having a plurality of negative pressure chambers partitioned in the width direction orthogonal to the transport direction of the ejection medium.

To achieve the object noted above, a liquid ejection device according to one aspect includes a transport unit, a medium support unit, a liquid ejection head, and a negative pressure generating unit. The transport unit is configured and arranged to transport an ejection medium. The medium support unit includes a negative pressure chamber and a medium support surface so that the ejection medium transported by the transport unit is supported on the medium support surface by suction using a negative pressure of the negative pressure chamber. The liquid ejection head is configured and arranged to eject liquid on the ejection medium supported on the medium support unit. The negative pressure generating unit is configured and arranged to generate the negative pressure to the negative pressure chamber of the medium support unit. The medium support unit includes a plurality of first recesses and at least one second recess formed in the medium support surface. The first recesses are in communication with the negative pressure generating unit. The first recesses are aligned along a width direction orthogonal to a transport direction of the ejection medium by the transport unit. The second recess is disposed at a position corresponding to an end part in the width direction of the ejection medium supported on the medium support surface. The second recess is configured and arranged to accept the liquid ejected from the liquid ejection head. The second recess is in communication with an adjacent one of the first recesses at a position inward of the end part of the ejection medium supported on the medium support surface. The first recesses are respectively in communication with the negative pressure generating unit via the negative pressure chamber partitioned into a plurality of units in the width direction.

With this arrangement, the negative pressure given to the negative pressure chamber partitioned in the width direction orthogonal to the transport direction of the ejection medium is given to the second recess that suctions the end part of the ejection medium, and to the adjacent first recess further to the inside of the ejection medium than the second recess. Therefore, it is possible to have the suction force of the second recess that suctions the ejection medium be a suction force according to the suction force at the first recess, so it is possible to stably support the ejection medium on the medium support surface using suction.

With the liquid ejection device of the above described aspect, the at least one second recess preferably includes a plurality of second recesses respectively disposed at positions corresponding to end parts in the width direction of a plurality of ejection media for which the width direction dimensions differ, and the negative pressure chamber is preferably partitioned by partition walls provided according to the positions of the second recesses provided on the medium support surface.

With this arrangement, it is possible to stably suction on the medium support unit the respective plurality of types of ejection medium for which the width dimension of the width direction orthogonal to the transport direction differs.

With the liquid ejection device of the above described aspect, each of the units of the negative pressure chamber preferably includes a communication unit in communication with the negative pressure generating unit, and the communication unit is preferably an elongated hole with a longitudinal direction of the elongated hole extending in the width direction.

With this arrangement, it is possible to make the flow of air suctioned to the negative pressure chamber uniform in the direction orthogonal to the transport direction, so at the plurality of first recesses arranged in the direction orthogonal to the transport direction, it is possible to suppress a pressure difference in the negative pressure given from the negative pressure chamber due to the arrangement positions.

With the liquid ejection device of the above described aspect, at least one of the first recesses preferably includes a suction hole in communication with the negative pressure chamber, and the communication unit is preferably disposed at a position spaced apart from the suction hole so as not to overlap with the suction hole as viewed along a normal line of the medium support surface.

With this arrangement, the air suctioned from the suction holes meanders and flows to the negative pressure chamber, so it is possible to make the flow of air suctioned to the negative pressure chambers uniform. Therefore, it is possible to suppress a difference in pressure of the negative pressure given from the negative pressure chambers to the plurality of first recesses.

With the liquid ejection device of the above described aspect, the negative pressure generating unit preferably includes a vent hole configured and arranged to allow ventilation through the communication unit, the vent hole being disposed at a position spaced apart from the communication unit so as not to overlap with the communication unit as viewed along a normal line of the medium support surface.

With this arrangement, the air suctioned from the communication unit meanders via the vent hole and flows to the negative pressure generating unit, so when liquid is suctioned from the suction hole, it is possible to inhibit liquid suctioned from the negative pressure chamber to the negative pressure generating unit from flowing to outside the negative pressure generating unit.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
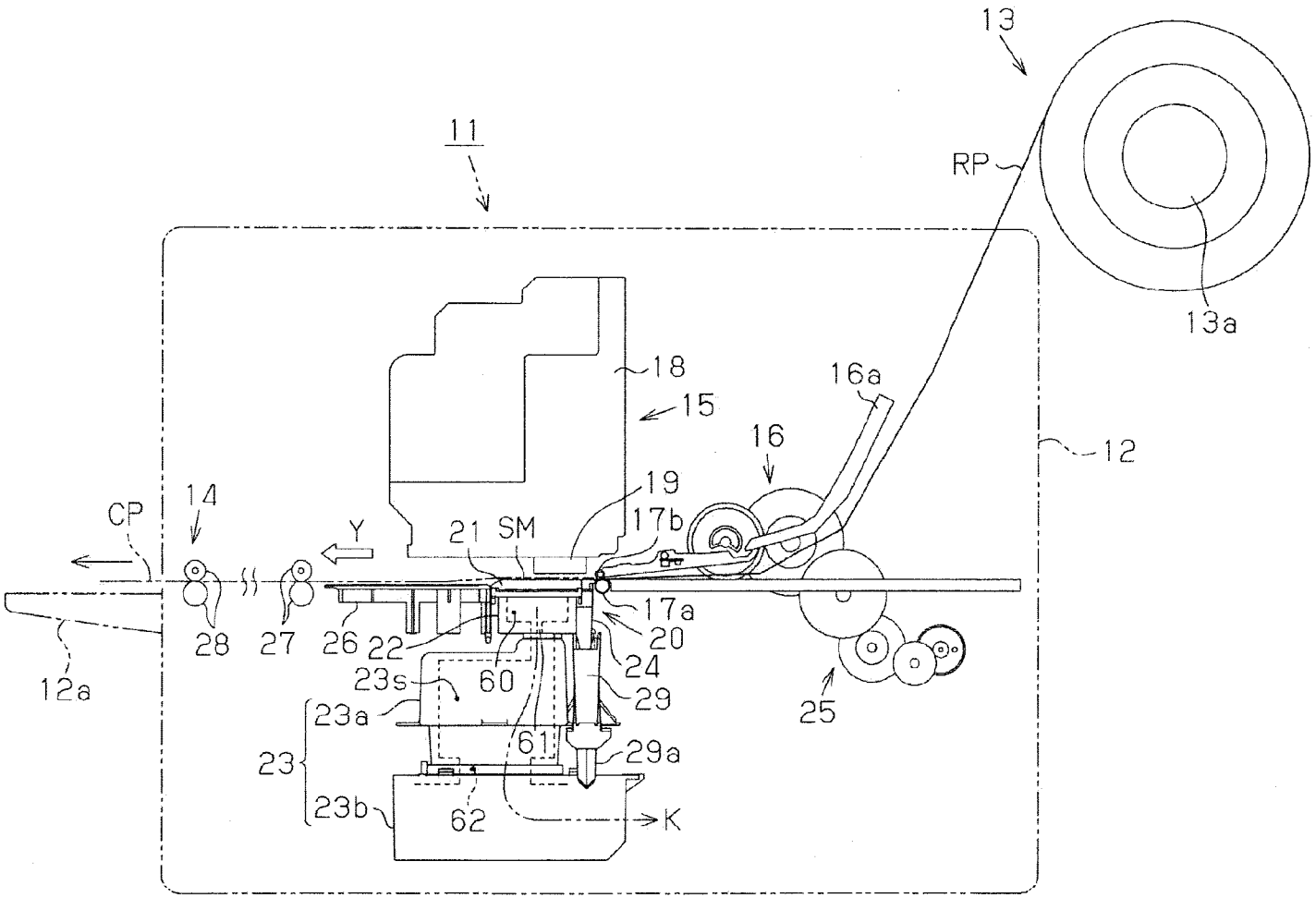
FIG. 1 is a schematic block diagram of a liquid ejection device which is an embodiment of the present invention.

Following, as an embodiment with the present invention in a specific example, we will describe an inkjet printer (hereafter referred to simply as "printer") as an example of a liquid ejection device, equipped with a liquid ejection head for ejecting liquid, for forming (printing) an image or the like containing text or graphics by ejecting liquid on paper (roll paper) as an ejection medium, while referring to the drawings.

As shown in FIG. 1, the printer 11 has a main unit case 12, and a paper supply unit 13 with the long sheet form paper RP supplied to the main unit case 12 equipped in a rolled state. Equipped inside the main unit case 12 are a liquid ejection unit 15 that ejects liquid on the supplied paper RP to form an image or the like, and a paper ejection unit 14 for ejecting from a paper ejection port provided on the main unit case 12 to a paper ejection tray 12*a* the paper RP on which an image or the like is formed as cut paper CP.

The paper supply unit 13 is equipped on the main unit case 12 on the side opposite to the paper ejection unit 14 so that the paper RP is able to rotate with a roll shaft 13*a* at the center, and supplies the paper RP into the main unit case 12. Inside the main unit case 12 is provided a transport path 16 equipped with a guide member 16*a* or the like by which the end part of the paper RP is guided. The end part of the paper RP which is supplied unwound from its rolled state as the roll shaft 13*a* is rotated is transported along this transport path 16, and in the transport path 16, is fed between a pair of rollers consisting of a paper feed roller 17*a* provided at the downstream end of the transport direction Y (white outline arrow direction in the drawing) of the transport path 16 and a paper pressing roller 17*b* which is driven by the rotation of this paper feed roller 17*a*. While being sandwiched by the paper feed roller 17*a* driven by a drive source (motor, not illustrated) and the paper pressing roller 17*b*, the paper RP is transported to the liquid ejection unit 15 side which is positioned at the transport direction Y downstream side. Therefore, with this embodiment, the paper feed roller 17*a* and the paper pressing roller 17*b* function as a transport unit.

The liquid ejection unit 15 is equipped with a carriage 18 on the upper side (antigravity direction side) of the transported paper RP. The carriage 18 is supported on a guide shaft (not illustrated) that is erected within the main unit case 12 in a state extending in a roughly horizontal direction along the width direction of the paper RP orthogonal to the transport direction (direction between the paper front side and back side in FIG. 1), and is able to move along the guide shaft. A liquid ejection head 19 is attached to the carriage 18 at the bottom surface side facing opposite the transported paper RP. A plurality of nozzles (not illustrated) for ejecting ink which is an example of the liquid are provided on the liquid ejection head 19, and by the carriage 18 moving back and forth along the width direction of the paper RP while being guided by the guide shaft, these move back and forth together with the carriage 18 in the direction along the guide shaft (also called the main scan direction X).

Also, the printer 11 is equipped with a medium support unit 20 that sandwiches the transported paper RP and supports the paper RP from the lower side (gravity direction side) at a position facing the liquid ejection head 19. The medium support unit 20 is equipped with a roughly rectangular shaped surface for which the main scan direction X is the longitudinal direction on the top surface facing opposite the liquid ejection head 19, and the paper RP is supported by suction on this top surface by negative pressure given to the medium support unit 20.

Specifically, the medium support unit 20 is equipped on its top surface with a roughly plate shaped support surface forming member 21 formed as a medium support surface SM (see FIG. 2) supporting the paper RP transported in the transport direction Y, and a support unit frame member 22 for which the top end is open joined and fixed to the bottom surface side which is the side opposite to the medium support surface SM. Then, an internal space is formed by the joined support surface forming member 21 and the support unit frame member 22, and this internal space functions as a negative pressure chamber 60 to which negative pressure is given in order to suction the paper RP to the medium support surface SM.

Also, with this embodiment, a negative pressure generating unit 23 connected so as to be in communication with the negative pressure chamber 60, consisting of a suction chamber 23*a* for suctioning air from the negative pressure chamber 60 and a rotating fan 23*b*, is provided on the bottom side of the medium support unit 20. On the negative pressure generating unit 23, at the suction chamber 23*a*, provided is a chamber internal space 23*s* that communicates with the negative pressure chamber 60 via the communication hole 61, and also ventilates to the rotating fan 23*b* side via the vent hole 62. Therefore, the negative pressure generated at the negative pressure generating unit 23 by the air (atmosphere) rotated by the rotating fan 23*b* flowing as shown by the double-dot-dash line arrow K in the drawing is given to the negative pressure chamber 60 via the chamber internal space 23*s*. Then, on the front surface of the paper RP supported by suction on the medium support unit 20 (the top surface in FIG. 1), by ink being ejected from the liquid ejection head 19, formation (printing) of an image or the like is performed by adhering of ink on the paper RP.

Also, inside the main unit case 12, further to the transport direction Y downstream side than the medium support unit 20 (support surface forming member 21), are equipped a guide plate 26 and intermediate roller pair 27 for transporting the paper RP from the medium support unit 20 side to the paper ejection unit 14 side. Further equipped is a paper ejection roller pair 28 for ejecting paper RP from the paper ejection port to the paper ejection tray 12*a*. Provided as necessary between the intermediate roller pair 27 and the paper ejection roller pair 28 are a cutter for cutting the paper RP after image formation to a cut paper CP of a designated length, and further to the transport direction Y downstream side than the cutter, a drying device for drying ink by blowing warm air (drying air) on the printed surface of the cut paper CP, and the like.

Furthermore, with the printer 11, for example in cases such as when exchanging the paper RP with a different paper RP of a different width dimension, reversing the roll shaft 13*a* and returning the paper RP from the liquid ejection unit 15 to the direction opposite to the transport direction Y are performed. At that time, a release mechanism 25 for releasing such that the paper pressing roller 17*b* is separated from the paper feed roller 17*a* is equipped using a gear train or the like.

Also, as shown in FIG. 1, with the printer 11 of this embodiment, when borderless printing is performed, the flow path tube 24 by which the ink ejected on the medium support unit 20 flows and is discharged is provided on the medium support unit 20. Then, within the main unit case 12, at the downward side which is the gravity direction side of the flow path tube 24, arranged is an ink guiding member 29 for which is provided a gutter shaped part 29*a* which receives ink discharged from the flow path tube 24 and flows it to a waste ink tank (not illustrated).

Now then, with this embodiment, a plurality of papers RP with differing width dimensions in the width direction orthogonal to the transport direction Y (hereafter also referred to simply as "width direction") are transported on the medium support unit 20. Then, when the transported paper RP is suctioned to the medium support surface SM, the constitution is such that the suction force in the width direction on the paper RP is made to be as uniform as possible. We will explain this constitution while referring to FIG. 2 through FIG. 4. In FIG. 3, the support surface forming member 21 is shown in a transparent state.

Figure 2:
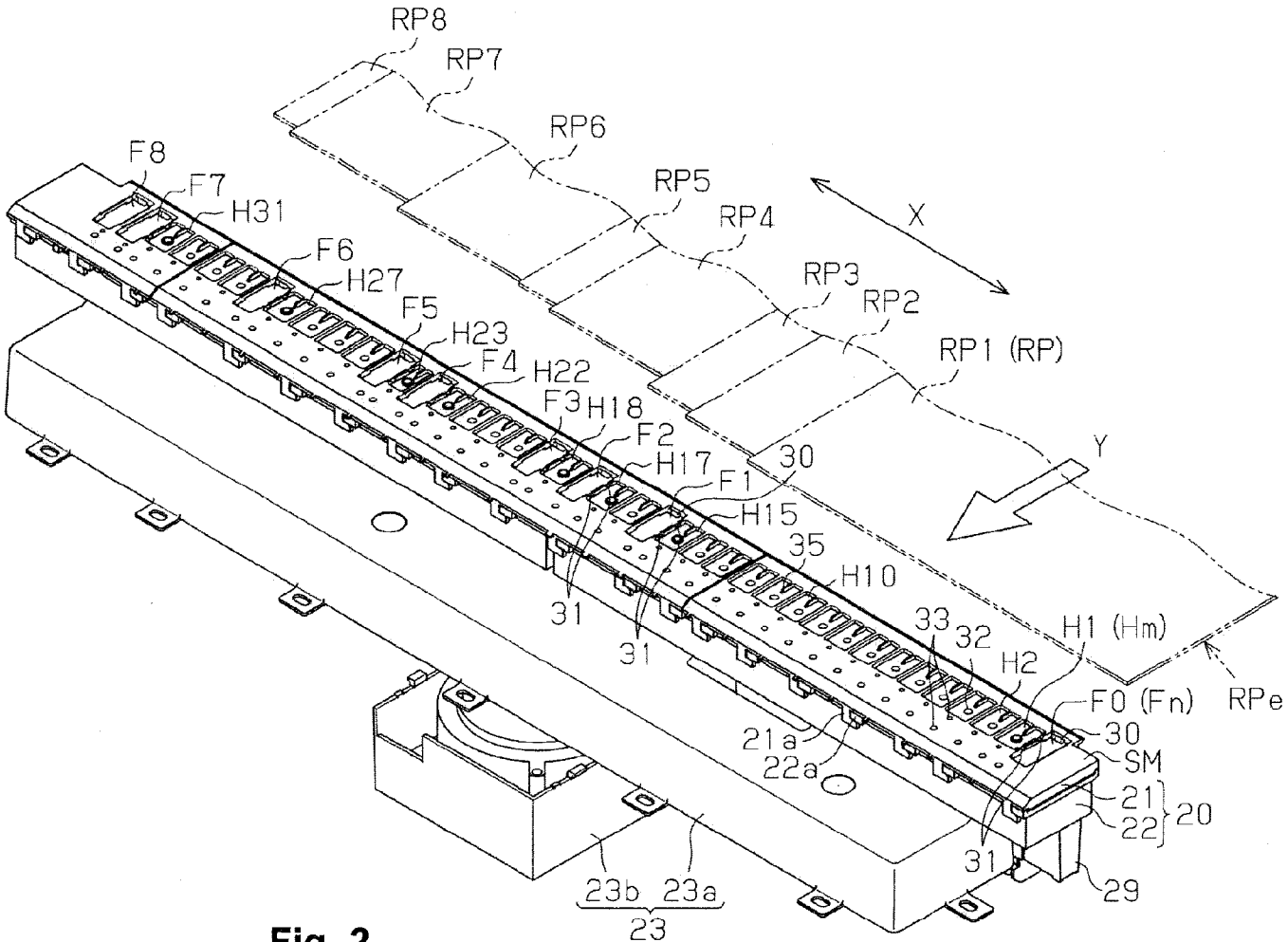
FIG. 2 is a perspective view showing a medium support unit equipped with a liquid ejection device of the embodiment.
Figure 3:
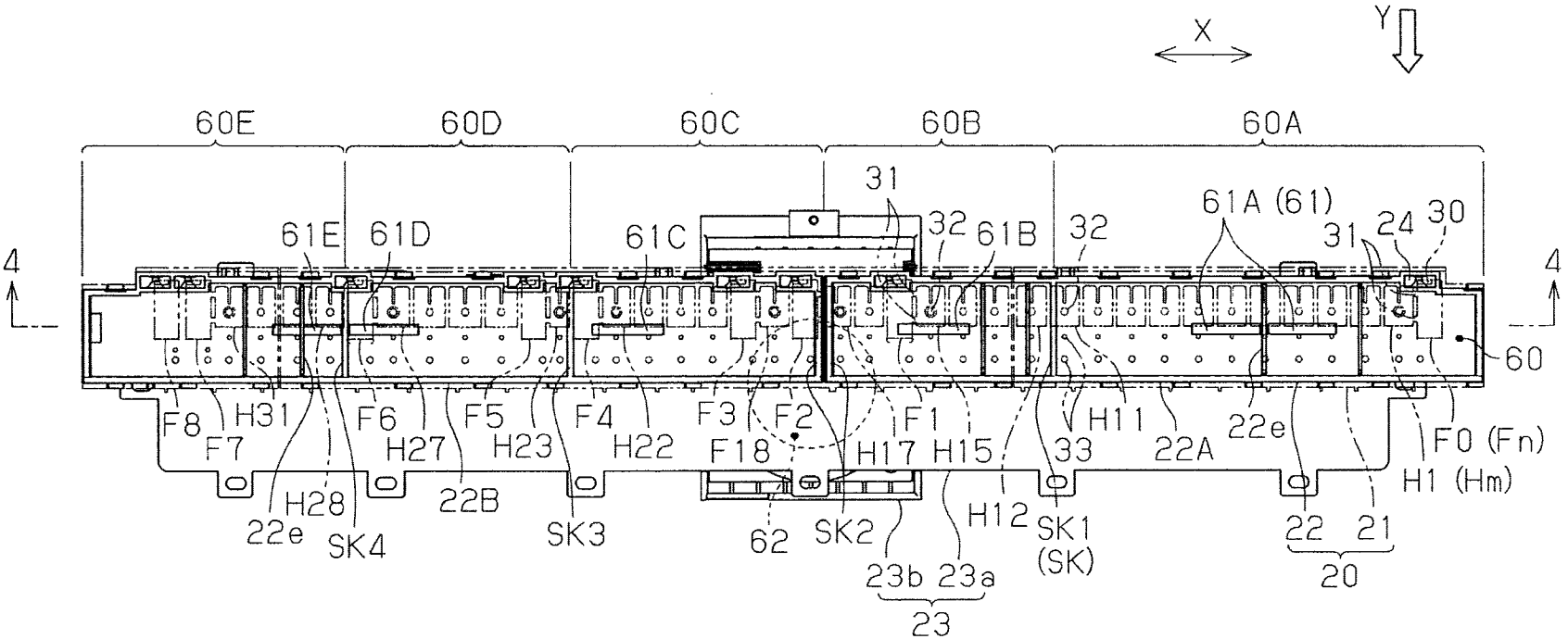
FIG. 3 is a plan view of the medium support unit of the embodiment seen from the normal line direction of the medium support surface.

As shown in FIG. 2, the medium support unit 20 is formed with a hook shaped member 21*a* provided on a roughly plate shaped support surface forming member 21 engaged with a plurality of projection sites 22*a* provided in the vicinity of the opening of a support unit frame member 22 having roughly a box shape which opens upward, so that the support surface forming member 21 and the support unit frame member 22 are joined and fixed.

On the support surface forming member 21, a plurality of first recesses Hm (m=1 to 31) and second recesses Fn (n=0 to 8), which are respectively formed with designated volume depressions downward so as to be open at the medium support surface SM and also to be separated from the supported paper RP, are provided aligned in the width direction orthogonal to the transport direction Y. With this embodiment, nine second recesses Fn (F0 to F8) that accept ink ejected from the liquid ejection head 19 during borderless printing are provided with a designated interval left open at positions corresponding to the respective width direction end parts of eight types of paper RP (RP1 to RP8) for which the width dimensions differ. Of these, the second recess F0 provided furthest to the left side seen from the upstream side of the transport direction Y is provided at a position for which all the respective end parts RPe of the left side correspond in common to the paper RP supported on the medium support unit 20. Said another way, each paper RP is transported on the medium support unit 20 in a state with all the end parts RPe of one of the papers RP moved to the left side seen from the transport direction Y upstream side so as to all be at the same position.

With this embodiment, ribs 35 are provided extending from the transport direction Y upstream side edge at the opening of the first recess Hm toward the transport direction Y downstream side. With the ribs 35, the transport direction Y upstream side at the opening of first recess Hm has the width direction width dimension formed to be smaller than at the downstream side, and the paper RP is suctioned stably to the medium support surface SM. Of course, it is not absolutely necessary to provide the ribs 35.

On each of the first recesses Hm provided on the medium support surface SM in this way, a suction hole 32 is provided in communication with the negative pressure chamber 60 at the depression formed part, and each first recess Hm is in communication with the negative pressure generating unit 23 by which negative pressure is generated by this suction hole 32. Also, each second recess Fn is in communication with the adjacent first recess Hm on the inside of the paper RP covered by the paper RP via a groove part 31 formed at a designated volume downward from the medium support surface SM, and the negative pressure of the negative pressure chamber 60 is given to the depression formed part of the first recess Hm via this groove part 31. Therefore, the paper RP is suctioned, including its end part, by the first recesses Hm and the second recesses Fn.

Incidentally, with this embodiment, there is communication respectively between the second recess F0 and the first recess H1, the second recess F1 and the first recess H15, and the second recess F2 and the first recess H17. There is also communication respectively between the second recess F3 and the first recess H18, and the second recess F4 and the first recess H22. Furthermore, there is also communication respectively between the second recess F5 and the first recess H23, the second recess F6 and the first recess H27, and the second recess F7 and the first recess H31.

At the transport direction Y upstream side end part of the depression formed part of each second recess Fn, vent holes 30 capable of ventilation from the bottom surface side of the side opposite the medium support surface SM side are provided in a roughly rectangular shape with the width direction as the longitudinal direction on the support surface forming member 21. As shown in FIG. 3, flow path tubes 24 provided at the transport direction Y upstream side are respectively connected to the vent holes 30.

With the flow path tube 24, on the interior, a flow path is formed that is a flow path not in communication with the negative pressure chamber 60, and by which the ink flows downward which is the gravity direction from vent hole 30. By the ink ejected on the second recesses Fn flowing in this flow path, it is discharged to the ink guiding member 29 arranged downward from the flow path tube 24. Therefore, the vent hole 30 functions as a discharge port for discharging the ink accepted by the second recess Fn during borderless printing from the depression formed part of the second recess Fn.

Now then, with this embodiment, the negative pressure chamber 60 for which the negative pressure generated at the negative pressure generating unit 23 is given is provided partitioned into a plurality by a partition wall in the width direction, the negative pressure given to the negative pressure chambers 60 partitioned by this partition wall passes through each suction hole 32, and is applied to the depression formed part of each first recess Hm.

Figure 4:
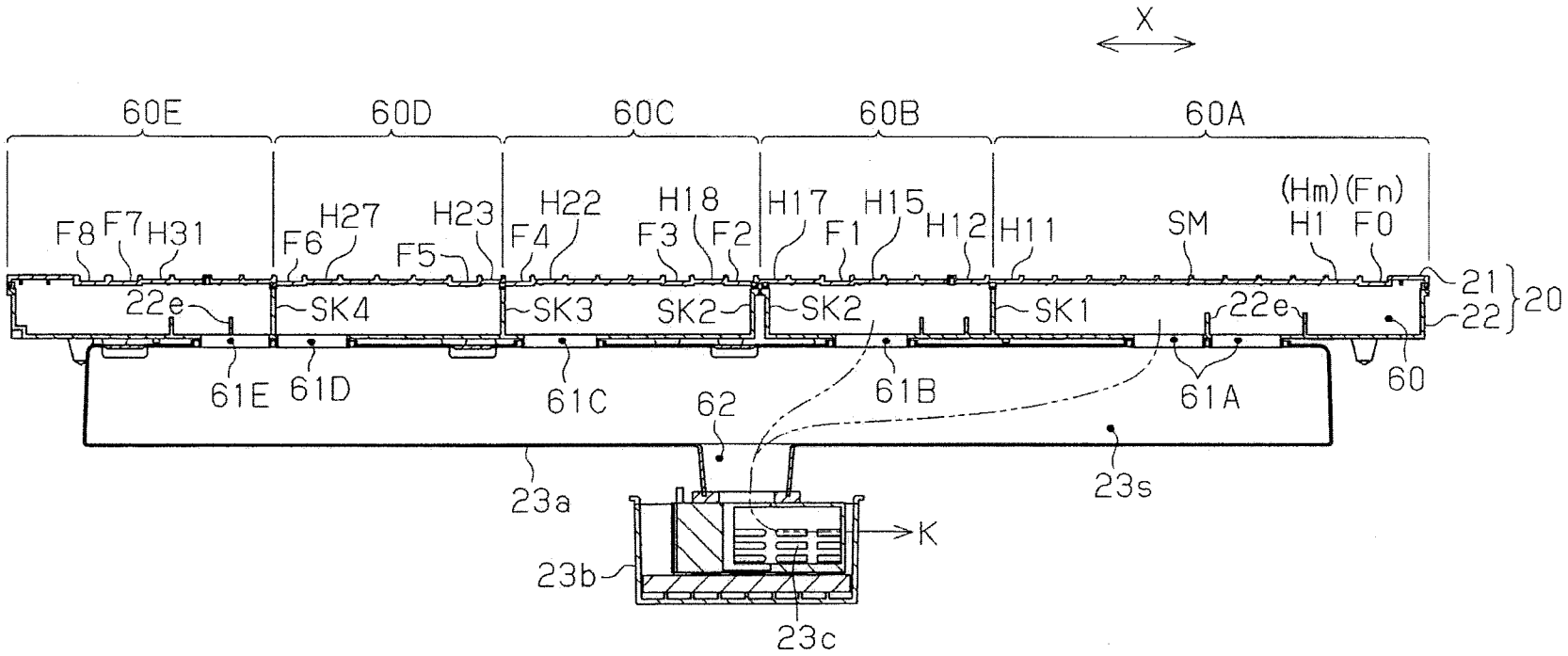
FIG. 4 is a cross section view of the medium support unit and the negative pressure generating unit cut at a surface orthogonal to the transport direction of the paper.

Next, we will describe this partitioned negative pressure chamber 60 while referring to FIG. 3 and FIG. 4.

As shown in FIG. 3 and FIG. 4, the roughly flat plate shaped support surface forming member 21 (double-dot-dash line in the drawing) constituting the medium support unit 20 and the negative pressure chamber 60 formed inside by the roughly box shaped support unit frame member 22 are partitioned into five units by partition walls SK1, SK2, SK3, and SK4. The partition walls SK1, SK2, SK3, and SK4 are wall surfaces provided extending in the transport direction Y and the perpendicular direction, and are provided at positions corresponding to the second recesses Fn.

With this embodiment, the support unit frame member 22 is divided into two in light of manufacturing circumstances or the like, the two member side walls of the support unit frame member 22 at this partitioned part are respectively set as partition wall SK2, and at the support unit frame member 22, are provided at corresponding positions between the second recess F2 and the first recess H17. Also, the partition wall SK3 and the partition wall SK4 are provided at the support unit frame member 22, with partition wall SK3 provided at the corresponding position between the second recess F4 and the first recess H23, and partition wall SK4 provided at the corresponding position between the second recess F6 and the first recess H28. More specifically, each partition wall SK is provided at the support unit frame member 22 at corresponding positions between the suction hole 32 of the first recess Hm provided in parallel in the width direction orthogonal to the transport direction Y and the suction hole 32 of the first recess Hm positioned adjacent in the width direction so as to sandwich the second recess Fn.

Also, with this embodiment, at the support unit frame member 22, the partition wall SK1 is provided at a corresponding position between the first recess H11 and the first recess H12 different from the position corresponding to the second recess Fn. One object of this is, when the negative pressure chamber 60 is long in the width direction, to suppress the occurrence of a difference due to the length of the width direction of the support unit frame member 22 being made shorter because it is easy for a difference to occur in the width direction by the negative pressure generated at the negative pressure chamber 60. Also, to reinforce the support unit frame member 22, ribs 22*e* having a designated width and height are provided at suitable locations along the transport direction Y.

With the partition walls SK1, SK2, SK3, and SK4 provided in this way, the negative pressure chamber 60 is partitioned respectively into negative pressure chambers 60A, 60B, 60C, 60D, and 60E. Provided respectively in each of the partitioned negative pressure chambers 60 are a communication hole 61 as a communication unit for communicating with the chamber internal space 23*s* inside the suction chamber 23*a* of the negative pressure generating unit 23.

With this embodiment, the communication hole 61 is formed by a rectangular shaped elongated hole that has the width direction orthogonal to the transport direction Y as the longitudinal direction. Then, two communication holes 61A that sandwich the rib 22*e* are provided at the negative pressure chamber 60A after partitioning so as to have the chamber internal space 23*s* and the negative pressure chamber 60A communicate. Similarly, at the negative pressure chamber 60B, one communication hole 61B, at negative pressure chamber 60C, one communication hole 61C, and at negative pressure chamber 60D, one communication hole 61D are provided so that the chamber internal space 23*s* and the respective negative pressure chamber 60 are in communication. Also, at the negative pressure chamber 60E, one communication hole 61E formed so that the rib 22*e* cuts across the upper part is provided so that the chamber internal space 23*s* and the negative pressure chamber 60E are in communication.

The communication holes 61 provided in this way are provided at positions displaced to the transport direction Y downstream side so as not to overlap the suction holes 32 provided on the first recesses Hm in the normal line direction view of the medium support surface SM. Furthermore, with this embodiment, the communication holes 61 are also provided at positions so as not to overlap the vent hole 62 at the rotating fan 23*b* side provided in the chamber internal space 23*s* in the normal line direction view of the medium support surface SM. Therefore, for example, in conjunction with air being discharged from the exhaust port 23*c* by rotation operation of the rotating fan 23*b*, the air suctioned from the suction hole 32 of the first recesses H1 to H11 meander within the negative pressure chamber 60 and flow into the communication hole 61A. Furthermore, the air that passes through the communication hole 61A and flows into the chamber internal space 23*s* meanders through the chamber internal space 23*s* and flows to the vent hole 62.

Figure 6:
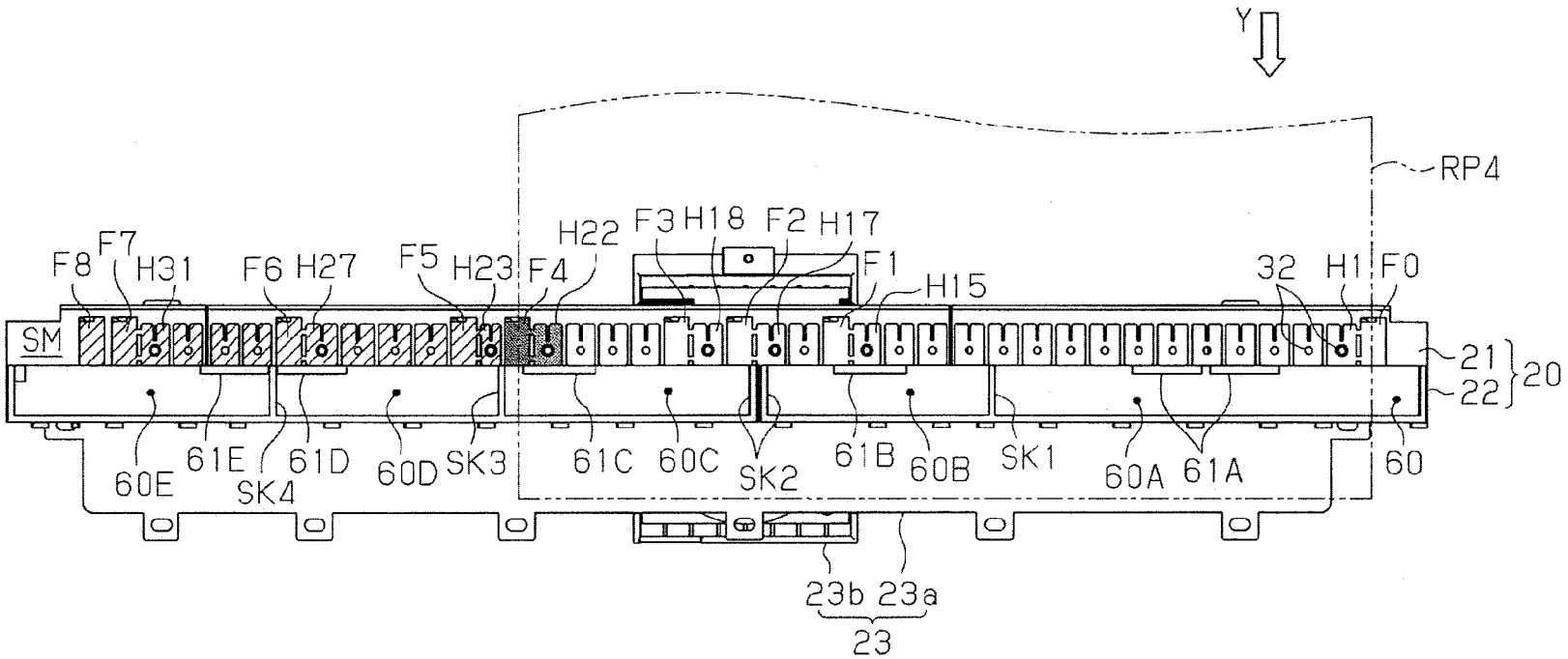
FIG. 6 is a plan view showing the state with the paper suctioned at a medium support unit having a negative pressure chamber of this embodiment.

Next, we will describe the operation of this embodiment when suctioning the paper RP at the medium support unit 20 equipped with the negative pressure chamber 60 partitioned in this way while referring to FIG. 6.

Figure 5:
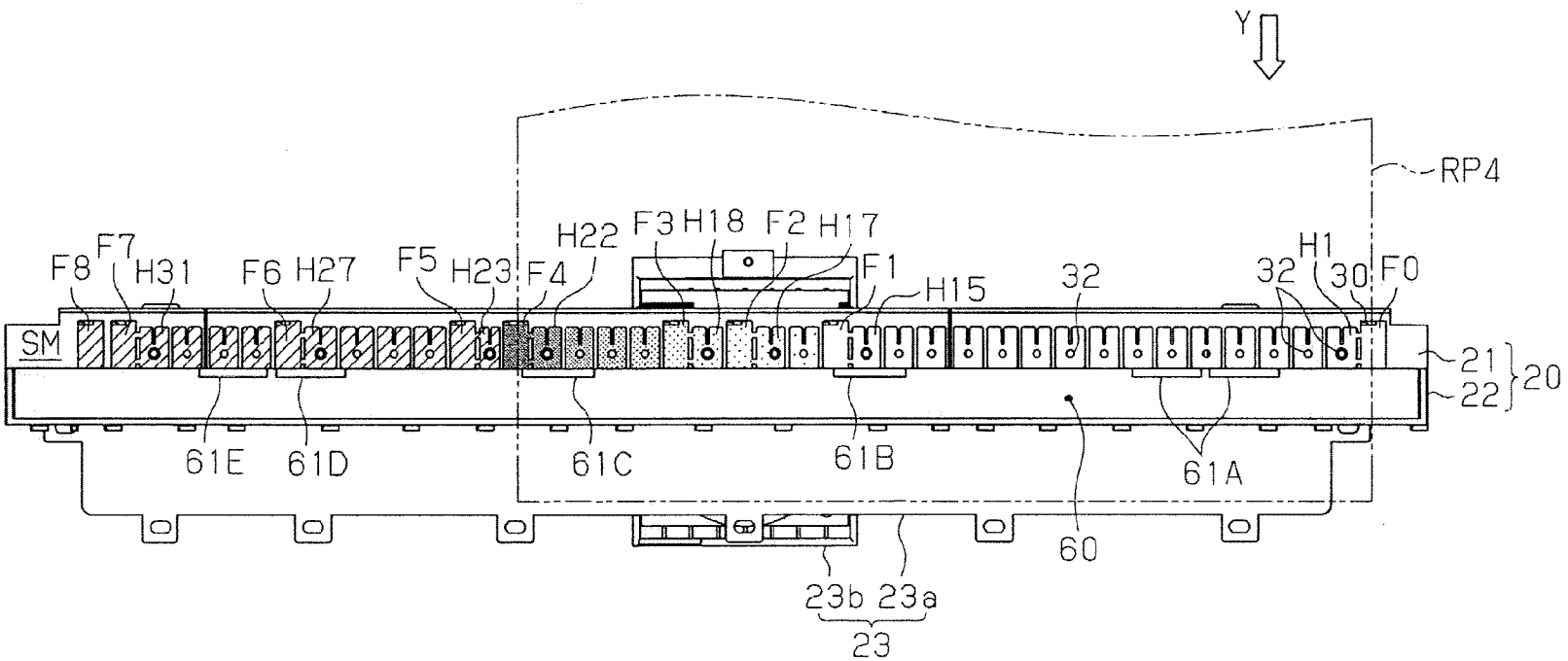
FIG. 5 is a plan view showing the state with the paper suctioned at a medium support unit having a negative pressure chamber of the prior art.

Before that, to make it easier to understand the explanation of the operation of this embodiment, we will describe the medium support unit 20 as a comparison example to this embodiment while referring to FIG. 5. The comparison example is an example equipped with one series of negative pressure chambers 60 for which the partition walls SK are not provided on the support unit frame member 22. With FIG. 5 and FIG. 6, as an example, the paper RP4 is suctioned, and to make it even easier to understand, the support surface forming member 21 of the medium support unit 20 is illustrated in a state cut near the transport direction Y downstream side opening edge at the opening of the first recess Hm, with the transport direction Y upstream side remaining. Also, the communication hole 61 of the comparison example has the same position and shape as the communication hole 61 of this embodiment.

As shown in FIG. 5, at the medium support unit 20 of the comparison example, the negative pressure chamber 60 is formed with a series of space areas across the entire medium support surface SM. With the comparison example, when the paper RP4 is suctioned to the medium support surface SM, the first recesses H23 to H31 provided aligned in a direction separated from the paper RP4 from the second recess F4 positioned at the end part of the width direction of the paper RP4 are in a state not covered by the paper RP4, so the atmosphere (air) flows to the negative pressure chamber 60 that is in a negative pressure state from the suction hole 32. That being the case, the air that has flowed to the negative pressure chamber 60 flows expanding to almost the entire area within the negative pressure chamber 60 that is a series of spaces with no partition walls.

By the flow of this air, with the space part of the negative pressure chamber 60 that communicates with the first recesses H1 to H22 that suction the paper RP4, the negative pressure is eased by the flowing air. In particular, the closer the first recess Hm is to the first recess H23 to H31 side (cross hatched part in the drawing) for which the atmosphere flows, the easier it is to have greater easing of the negative pressure of the communicating negative pressure chamber 60 part. As a result, the first recess H22 of the side near the first recess H23 for which the suction hole 32 to which the paper RP4 is not suctioned is open to the air has the greatest easing of negative pressure, and the suction force decreases, and the decrease in suction force of the first recess Hm from the first recess H22 toward the first recess H1 side gradually becomes smaller as shown by the half-tone shaded part in the drawing. In this way, with the comparison example, because the partition wall SK is not provided, in principle, there is a decrease in the negative pressure given to the first recess Hm that suctions the paper RP4 with the inflowing air flowing in across the broad range of the negative pressure chamber 60. Incidentally, with this comparison example, the decrease in negative pressure occurs in a broad range from the first recess H22 up to almost the first recess H15.

In contrast to this, as shown in FIG. 6, with the medium support unit 20 of this embodiment, the negative pressure chamber 60 is formed by five negative pressure chambers 60A to 60E for which the entire area of the medium support surface SM is partitioned into a plurality. With this embodiment, when the paper RP4 is suctioned to the medium support surface SM, the first recesses H23 to H31 provided aligned in the direction separating from the paper RP4 from the second recess F4 positioned at the end part of the width direction of the paper RP4 (cross hatching part in the drawing) are in a state not covered by the paper RP4, so the atmosphere (air) flows from the suction holes 32 to the negative pressure chambers 60D and 60E that are in a negative pressure state.

The negative pressure given to the negative pressure chambers 60D and 60E is smaller due to this flow of air, but air does not flow directly to the negative pressure chambers 60A, 60B, and 60C that give negative pressure to the first recesses H1 to H22 that suction the paper RP4. Specifically, the air flows from the communication holes 61D and 61E provided on the negative pressure chambers 60D and 60E via the chamber internal space 23*s*, and respectively from the communication holes 61A, 61B, and 61C to the negative pressure chambers 60A, 60B, and 60C, so a large flow path resistance is formed between each of the negative pressure chambers 60. As a result, the air that flows from the suction holes 32 of the first recesses H23 to 31 is suppressed from flowing to the negative pressure chambers 60A, 60B, and 60C, and the occurrence of a decrease in the suction force of the paper RP4 is suppressed.

Also, with this embodiment, the partition walls are provided at corresponding positions between the suction holes 32 of the two first recesses Hm that sandwich the second recess Fn, so the negative pressure applied to the second recess F4 that suctions the end part of the paper RP4 becomes an item for which the negative pressure applied to the first recess H22 that suctions the paper RP4 is applied via the groove part 31. Therefore, the paper RP4 is suctioned according to the negative pressure applied to the first recesses H1 to H22 at the entire area of the width direction across the end part.

Of course, the negative pressure applied to the second recess F0 that suctions the other end part RPe of the paper RP4 becomes an item for which the negative pressure applied to the first recess H1 that suctions the paper RP4 is applied via the groove part 31. Therefore, the negative pressure applied to the second recess F0 that is accompanied by pressure loss due to the flow resistance of the groove part 31 has a size according to the negative pressure applied to the first recess H1. Therefore, the paper RP4 is suctioned according to the negative pressure applied to the first recesses H1 to H22 at the entire area of the width direction across the end part.

With the embodiment noted above, it is possible to obtain the following kinds of effects.

(1) The negative pressure given to the partitioned negative pressure chamber 60 is given to the second recess Fn that suctions the end part of the paper RP via the first recess Hm adjacent to the second recess Fn on the inside of the paper RP. Therefore, it is possible to have the suction force of the second recess Fn that suctions the paper RP be a suction force according to the suction force of the first recess Hm, so it is possible to stably suction and support the paper RP on the medium support surface SM.

(2) The negative pressure chamber 60 is partitioned by the partition walls SK provided according to the positions of the second recesses Fn provided on the medium support surface SM, so it is possible to respectively stably suction the plurality of types of paper RP with different width dimensions in the width direction orthogonal to the transport direction Y on the medium support unit 20.

(3) The negative pressure chamber 60 is provided with the elongated hole communication holes 61 that communicates with the negative pressure generating unit 23 at each respective partitioned item, so it is possible to make the flow of air suctioned to the negative pressure chamber 60 uniform in the direction orthogonal to the transport direction Y. As a result, it is possible to suppress a pressure difference in the negative pressure given from the negative pressure chambers 60 due to the arrangement position for the plurality of first recesses Hm arranged in the width direction orthogonal to the transport direction Y.

(4) The air suctioned from the suction hole 32 of the first recess Hm meanders and flows in the negative pressure chamber 60, so it is possible to make the flow of air suctioned to the negative pressure chamber 60 uniform. Therefore, it is possible to suppress a pressure difference in the negative pressure given from the negative pressure chambers 60 at the plurality of first recesses Hm. Also, when mist form ink is suctioned from the suction hole 32, it is possible to inhibit the flow of mist form ink suctioned from the negative pressure chamber 60 side to the negative pressure generating unit 23 side.

(5) The air suctioned from the communication hole 61 meanders via the vent hole 62 and flows to the negative pressure generating unit 23, so when ink is suctioned from the suction hole 32, it is possible to inhibit the ink suctioned from the negative pressure chamber to the negative pressure generating unit from flowing to outside the negative pressure generating unit 23.

The embodiment noted above can also be modified as noted below.

Figure 7:
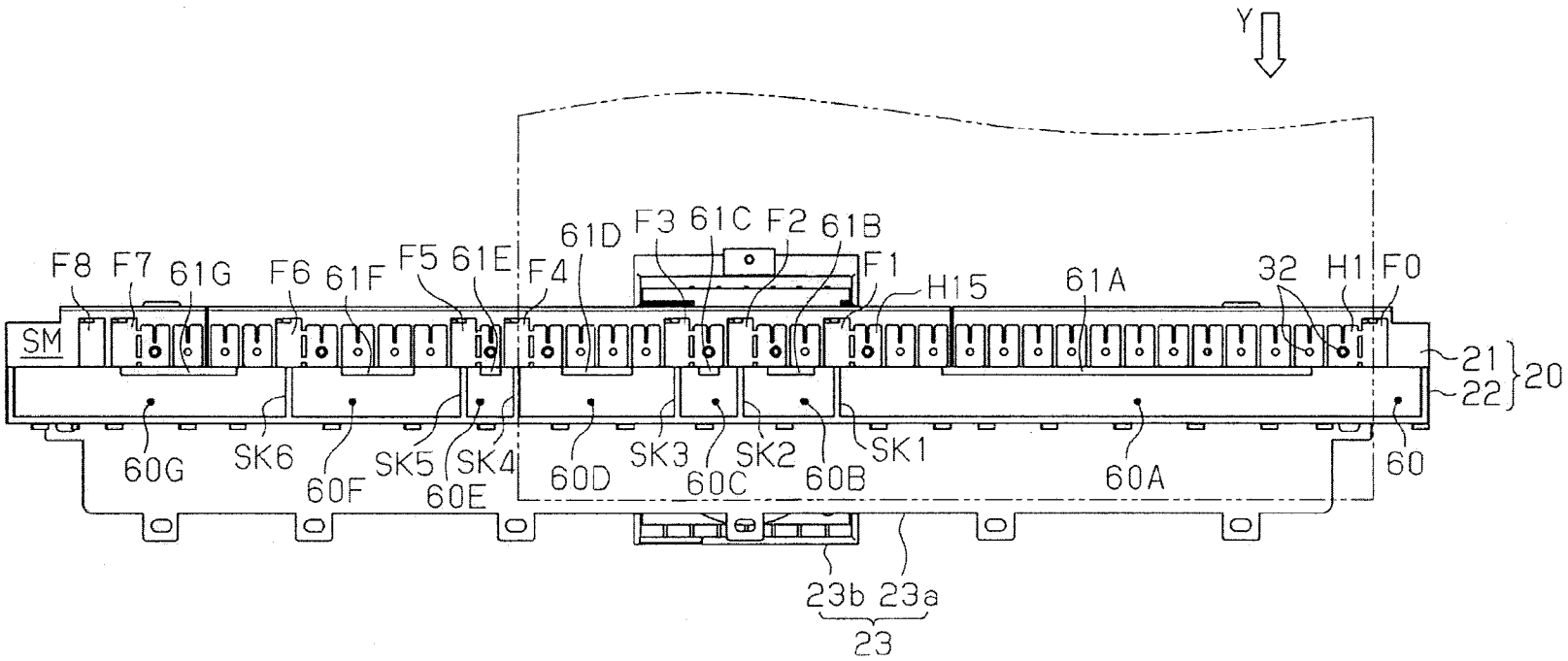
FIG. 7 is a plan view showing a modification example of the formation position of the partition wall that partitions the negative pressure chamber.

With the embodiment noted above, when partitioning the negative pressure chamber 60 using the partition walls SK, the positions at which the partition walls SK are provided can also be provided so as to be positions according to all the second recesses Fn in the normal line direction view of the medium support surface SM. For example, as shown in FIG. 7, these can be respectively provided with the partition wall SK1 at a position overlapping the second recess F1, the partition wall SK2 at a position overlapping the second recess F2, the partition wall SK3 at a position overlapping the second recess F3, the partition wall SK4 at a position overlapping the second recess F4, the partition wall SK5 at a position overlapping the second recess F5, and the partition wall SK6 at a position overlapping the second recess F6.

Then, the negative pressure chamber 60 is partitioned into seven negative pressure chambers 60 (60A to 60G) by the provided six partition walls SK. Communication holes 61 (61A to 61G) are formed respectively on the seven partitioned negative pressure chambers 60. Of course, the communication holes 61 (61A to 61G) preferably are made so that a big difference does not occur in the negative pressure given from the suction chamber 23*a*, such as forming them for example having a hole surface area of a size according to the space capacity of the respective negative pressure chambers 60.

With this modification example, using the negative pressure chambers 60 partitioned for each width dimension of the paper RP, for all the papers RP, the paper RP is always suctioned by the negative pressure chamber 60 of the same width dimension and positioned in the same range, so it is possible to always stably suction the paper RP across the entire width direction.

With the embodiment noted above, the positions at which the communication holes 61 are formed are not limited to the positions shown in FIG. 3, but can be various other positions. Also, the shape of the communication holes 61 is not limited to the shape shown in FIG. 3, and can be various other shapes. We will describe this modification example while referring to FIG. 8.

Figure 8:
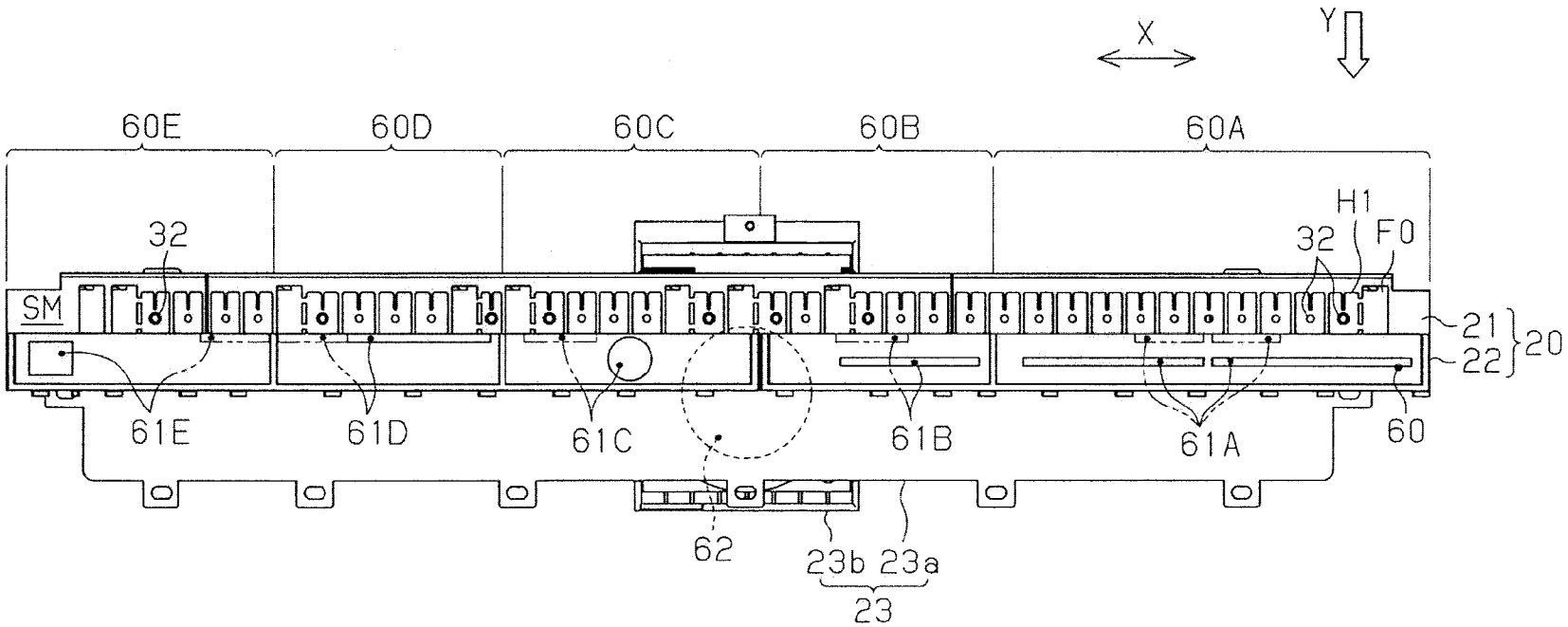
FIG. 8 is a plan view showing a modification example of a communication hole that provides communication between the negative pressure chamber and the negative pressure generating unit.

For example, it is also possible to form the communication holes 61 provided in the negative pressure chamber 60 to be even longer in the width direction (main scan direction X), or to be moved in the transport direction Y. As an example, as shown in FIG. 8, it is also possible to form the communication hole 61D provided on the negative pressure chamber 60D to be longer in the width direction (main scan direction X). By doing this, it is possible to make the negative pressure given from the communication hole 61D to the suction hole 32 even more uniform than with the embodiment noted above.

Furthermore, as shown in FIG. 8, it is also possible to form the communication hole 61A provided on the negative pressure chamber 60A to be even longer in the width direction, and at a position moved to the downstream side of the transport direction Y. By doing this, it is possible to make the negative pressure given to the suction hole 32 from the communication hole 61A even more uniform than the embodiment noted above, and also, by positioning it displaced even more to the transport direction Y downstream side in relation to the suction hole 32 in the normal line direction view of the medium support surface SM, it is possible to have the air that flows from the suction hole 32 meander within the negative pressure chamber 60A.

When this modification example is applied to the negative pressure chamber 60B close to the rotating fan 23*b*, for example, it is preferable to provide the communication hole 61B at a separated position that does not overlap the vent hole 62 in the normal line direction view of the medium support surface SM. By doing this, it is possible to have the air suctioned from the communication hole 61B meander to the vent hole 62, so it is possible to suppress the ink suctioned to the negative pressure chamber 60B from flowing from the negative pressure chamber 60B to the negative pressure generating unit 23.

Alternatively, the shape of the communication hole 61 provided in the negative pressure chamber 60 is not limited to being a rectangular elongated hole, but for example can also be a circle, oval, or a polygon shape. As an example, as shown in FIG. 8, the communication hole 61C provided in the negative pressure chamber 60C can be formed as a circle, and the communication hole 61E provided at the negative pressure chamber 60E can be formed as a roughly square shape. Also, when forming the communication hole 61 in a shape that does not have a longitudinal direction in this way, for example as shown by example with the negative pressure chamber 60E, it is also acceptable to form it at a position separated from each suction hole 32 in the normal line direction view of the medium support surface SM. By doing this, it is possible to have the air suctioned from the suction hole 32 meander and flow to the communication hole 61E.

With the embodiment noted above, it is also possible to equip a plurality of the negative pressure generating units 23 (rotating fan 23*b*) for the negative pressure generating unit 23. As an example, we will describe a case when two negative pressure generating units 23 are equipped while referring to FIG. 9.

Figure 9:
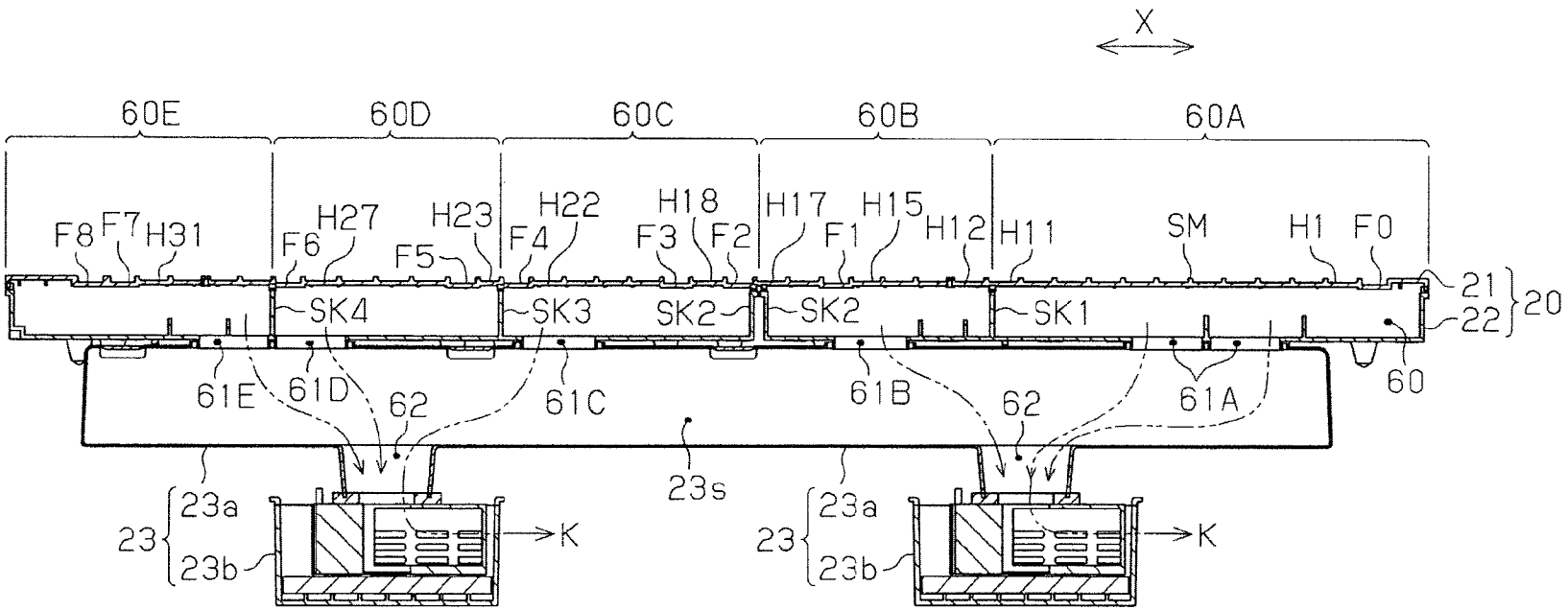
FIG. 9 is a cross section view of the medium support unit and the negative pressure generating unit of a modification example for which a plurality of negative pressure generating units are equipped, cut at a surface orthogonal to the transport direction of the paper.

As shown in FIG. 9, with this modification example, at the suction chamber 23*a*, vent holes 62 are formed at two locations having a designated gap in the width direction, and by connecting the rotating fan 23*b* to the respectively formed vent holes 62, two negative pressure generating units 23 are formed. By doing this, the air volume suctioned at the chamber internal space 23*s* of the suction chamber 23*a* becomes more uniform for the overall area in the width direction with this modification example for which there are two negative pressure generating units 23 (rotating fan 23*b*) than with the embodiment noted above for which there is one negative pressure generating unit 23.

Specifically, one negative pressure generating unit 23 mainly suctions air via the vent holes 62 from the communication hole 61A and the communication hole 61B and gives negative pressure to the negative pressure chambers 60A and 60B, and the other negative pressure generating unit 23 mainly suctions air via the vent holes 62 from the communication hole 61C, the communication hole 61D, and the communication hole 61E and gives negative pressure to the negative pressure chambers 60C, 60D, and 60E. Therefore, the distance between the rotating fan 23*b* for which the air from each communication hole 61 is mainly suctioned and the communication hole 61 becomes shorter, so a difference in the flow path resistance of the air between these is suppressed, and the negative pressure given to the negative pressure chambers 60A and 60B and to the negative pressure chambers 60C, 60D, and 60E is made more uniform.

With this modification example, the chamber internal space 23*s* within the suction chamber 23*a* can also be partitioned into two with vent holes 62 provided in respectively different chamber internal spaces in the width direction. By doing this, by adjusting the respective fan rotation speed at each rotating fan 23*b*, it is possible to reliably and individually adjust the negative pressure given to the negative pressure chambers 60A and 60B or the negative pressure given to the negative pressure chambers 60C, 60D, and 60E. As a result, an even greater level of uniformity of the negative pressure given to the negative pressure chambers 60A and 60B and to the negative pressure chambers 60C, 60D, and 60E can be expected.

With the embodiment noted above, the communication hole 61 does not have to be provided at a separated positions that does not overlap with the suction hole 32 in communication with the negative pressure chamber 60 provided in the first recess Hm in the normal line direction view of the medium support surface SM. For example, the communication hole 61 can also be provided such that at last a portion overlaps the suction hole 32 in the normal line direction view of the medium support surface SM.

With the embodiment noted above, the negative pressure generating unit 23 does not have to have the vent hole 62 capable of ventilation with the communication hole 61 side at a separated position that does not overlap the communication hole 61 in the normal line direction view of the medium support surface SM. For example, it is also possible to provide the communication hole 61 such that at least a portion overlaps the vent hole 62 in the normal line direction view of the medium support surface SM.

With the embodiment noted above, the ejection medium is not limited to being paper (roll paper), and can also be a sheet type member which uses a material such as a metal plate, resin plate, fabric or the like. As long as it is a member for which it is possible to form an image or the like using the liquid ejected from the liquid ejection head 19, it can be used as the ejection medium.

With the embodiment noted above, with the liquid ejection head 19, the liquid storage container in which the ejected liquid is housed can be an on-carriage type which is placed on the carriage 18, or the liquid storage container can also be an off-carriage type which is not placed on the carriage 18. Alternatively, this is not limited to being a serial type printer for which the carriage 18 moves in the main scan direction X, but can also be a line head type printer for which it is possible to do maximum width range printing of the paper RP even with the liquid ejection head 19 remaining fixed.

With the embodiment noted above, the liquid ejection device was put into specific form as the printer 11 for ejecting ink as the liquid, but it is also possible to make it into a specific form as a liquid ejection device that ejects or discharges a liquid other than ink. Various types of liquid ejection device equipped with a liquid ejection head or the like for discharging tiny volume droplets can be appropriated for this. Droplets means the state of liquid discharged from the aforementioned liquid ejection device, and includes granular shapes, tear shapes, and threadlike shapes with a tail. Also, what is called liquid here is sufficient as long as it is a material that can be ejected by the liquid ejection device. For example, it is sufficient as long as it is an item in a state when the property is liquid phase, and includes not only liquid bodies with high or low viscosity, fluid bodies such as sol, gel water, other inorganic solvents, organic solvents, solutions, liquid resin, liquid metal (metal melt), or a liquid as one state of a substance, but also includes items such as items for which particles of functional materials consisting of a solid such as a pigment, metal particle or the like is dissolved, dispersed, or blended in a solvent. Also, as a representative example of a liquid, we can list the ink or liquid crystal or the like such as those described with the embodiment noted above. Here, ink includes typical water based inks, oil based inks, as well as various liquid compositions such as gel ink, hot melt ink and the like. As a specific example of the liquid ejection device, for example, there are liquid ejection devices which eject liquid including materials such as electrode materials or coloring materials or the like in a dispersed or dissolved form used in manufacturing items such as liquid crystal displays, EL (electro luminescence) displays, surface light emitting displays, color filters and the like. Alternatively, it is also possible to be a liquid ejection device for ejecting bioorganic material used for biochip manufacturing, a liquid ejection device for ejecting a liquid that will be a sample used for a precision pipette, a textile printing device, a micro dispenser or the like. Furthermore, it is also possible to use a liquid ejection device for ejecting lubricating oil with a pinpoint on precision machines such as watches, cameras or the like, a liquid ejection device for ejecting a transparent resin liquid such a ultraviolet curing resin or the like for forming a miniature hemispheric lens (optical lens) used for optical communication elements or the like on a substrate, or a liquid ejection device for ejecting an acid or alkaline or the like etching fluid for etching a substrate or the like. Then, it is possible to apply the present invention to any one type of liquid ejection device among these.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a transport unit configured and arranged to transport an ejection medium in a transport direction;

a medium support unit including a negative pressure chamber and a medium support surface so that the ejection medium transported by the transport unit is supported on the medium support surface by suction using a negative pressure of the negative pressure chamber, the negative pressure chamber having a first negative chamber part and a second negative chamber part, the medium support unit further including a first wall and a second wall, the first wall partitioning the first negative chamber part and the second negative chamber part in a width direction orthogonal to the transport direction, the second wall opposing the first wall in the width direction, the first negative chamber part being defined by at least the medium support surface, the first wall, and the second wall;

a liquid ejection head configured and arranged to eject liquid on the ejection medium supported on the medium support unit; and a negative pressure generating unit configured and arranged to generate the negative pressure to the negative pressure chamber of the medium support unit, the medium support unit further including a plurality of first recesses formed in the medium support surface, and in communication with the negative pressure generating unit, the first recesses being aligned along the width direction, and at least one second recess formed in the medium support surface, and disposed at a position corresponding to an end part in the width direction of the ejection medium supported on the medium support surface, the second recess being configured and arranged to accept the liquid ejected from the liquid ejection head, the second recess being in communication with an adjacent first recess that is an adjacent one of the first recesses at a position inward of the end part of the ejection medium supported on the medium support surface, and the first recesses being respectively in communication with the negative pressure generating unit via the negative pressure chamber, the adjacent first recess and the second recess being disposed between the first wall and the second wall in the width direction such that both of the adjacent first recess and the second recess are disposed between a first hypothetical plane and a second hypothetical plane, the first hypothetical plane and the second hypothetical plane extending along the first wall and the second wall, respectively.

2. The liquid ejection device according to claim 1, wherein the at least one second recess includes a plurality of second recesses respectively disposed at positions corresponding to end parts in the width direction of a plurality of ejection media for which the width direction dimensions differ, and the first wall and the second wall are arranged according to the positions of the second recesses provided on the medium support surface.

3. The liquid ejection device according to claim 1, wherein each of the first and second negative pressure chamber parts includes a communication unit in communication with the negative pressure generating unit, and the communication unit is an elongated hole with a longitudinal direction of the elongated hole extending in the width direction.

4. The liquid ejection device according to claim 3, wherein at least one of the first recesses includes a suction hole in communication with the negative pressure chamber, and the communication unit is disposed at a position spaced apart from the suction hole so as not to overlap with the suction hole as viewed along a normal line of the medium support surface.

5. The liquid ejection device according to claim 3, wherein the negative pressure generating unit includes a vent hole configured and arranged to allow ventilation through the communication unit, the vent hole being disposed at a position spaced apart from the communication unit so as not to overlap with the communication unit as viewed along a normal line of the medium support surface.

6. The liquid ejection device according to claim 1, wherein the negative pressure chamber further has a bottom part facing the medium support surface, the bottom part defines the first and second negative pressure chamber parts, and each of the first and second negative pressure chamber parts includes a communication unit that is formed through the bottom part and in communication with the negative pressure generating unit.

* * * * *